US005157813A

United States Patent [19]

Carroll

[11] Patent Number: 5,157,813

[45] Date of Patent: Oct. 27, 1992

[54] SHOELACE TENSIONING DEVICE

[76] Inventor: William Carroll, 12861 Western Ave., Unit A, Garden Grove, Calif. 92641-4164

[21] Appl. No.: 785,948

[22] Filed: Oct. 31, 1991

[51] Int. Cl.[5] ..... A43C 11/00

[52] U.S. Cl. ..... 24/68 SK; 24/68 B; 36/119

[58] Field of Search ..... 24/68 SK, 68 B, 71.1, 24/71.2; 36/50, 117, 119; 256/40, 41, 42, 43; 74/553

[56] References Cited

U.S. PATENT DOCUMENTS

| | | | |
|---|---|---|---|
| 475,383 | 5/1892 | Cleaveland | 256/42 |
| 4,433,456 | 2/1984 | Baggio | 24/68 SK |
| 4,616,524 | 10/1986 | Bidoia | 36/119 |
| 4,633,599 | 1/1987 | Morell et al. | 24/68 SK |
| 4,653,204 | 3/1987 | Morell et al. | 24/68 SK |
| 4,680,878 | 7/1987 | Pozzobon et al. | 36/50 |
| 4,719,710 | 1/1988 | Pozzobon | 24/68 SK |
| 4,748,726 | 6/1988 | Schoch | 24/68 B |

OTHER PUBLICATIONS

Laces for the Lazy, one sheet, no date.

Lacers Speed Locks, two sheets, no date.

*Primary Examiner*—Victor N. Sakran

*Attorney, Agent, or Firm*—Charles H. Thomas

[57] ABSTRACT

A device is provided for regulating the tension on shoelaces of the type worn in conventional footwear. The shoelace tension regulating device is mounted on the top of the shoe with which it is used, preferably by lacing the shoelace ends through a pair of apertures in the housing of the device. The shoelace ends which emanate from the uppermost eyelets of the shoe adjacent the wearers ankle are not tied, as in conventional practice, but are captured by a hook mechanism that is wound onto a drum within the device by means of a crank in the form of a rotatable cap. The drum is carried in rotation as the cap is turned until the desired level of tension on the shoelace ends has been achieved. A pawl and ratchet wheel in the device prevent counter-rotation until the user desires to release tension on the shoelace ends, at which time the pawl can be disengaged from the ratchet wheel by an actuating mechanism operable externally of the device. An internal helically wound band spring interposed between the drum and the crank permits slight reciprocal movement of the shoelace ends to avoid excessive tension when the footwear upper is severely flexed, and to also avoid excessively reduced tension when the users foot is relaxed.

19 Claims, 3 Drawing Sheets 7
34
98
26
28
72
76
52
42
80
66
82
70
84
50
54
80
68
78
74
38
30
32
62
48
64
60
58
56
24
7

SHOELACE TENSIONING DEVICE

BACKGROUND OF THE INVENTION

1. Field of the Invention

The present invention relates to a device for regulating tension on shoelaces that are laced through the eyelets of shoes.

2. Description of the Prior Art

Many conventional shoes, particularly shoes worn for participation in athletic events, are formed with a plurality of reinforced eyelets which extend on both sides of the center of the upper from the vamp up to the ankle of the shoe. The eyelets are located on the facing edges of the shoe upper directly over the tongue of the shoe. A shoelace is then laced through the eyelets. The free ends of the shoelace are typically encased within small, rigid, cylindrical plastic tips which facilitate insertion of the shoelace ends through the eyelets. The ends of the shoelace are first passed through the eyelets adjacent the vamp and are progressively laced upwardly, crossing over the tongue each time from one eyelet to the next from the vamp of the shoe up to the ankle. Once the free ends of the shoelace have been threaded through the uppermost eyelets at the ankle of the shoe they are normally tied together.

In vigorous athletic contests the feet of a wearer, and consequently the shoes, undergo a great deal of flexing movement. As a result, shoelaces which are tied under a light tension to hold the shoe comfortably on the foot of the wearer are placed in far greater tension with flexing movement of the wearer's foot and sometimes with swelling of the foot within the shoe. Since the ends of the shoelace are tied together the length of the portion of the shoelace that is laced through the eyelets is fixed. Thus, the shoelace cannot yield to any significant degree during flexing of the shoe. As a consequence, the increased tension in the shoelace during flexure creates discomfort to the foot of the wearer.

Very often the flexing movement of a shoe, the lace of which is tied too tightly, will cause the shoelace to be drawn tightly across the top of the foot of the wearer. This creates discomfort to the wearer. Indeed, the imprints of the tightly drawn shoelaces can often be seen in the skin of the top of the wearers foot when the shoe and sock are removed if the shoelace has been tied too tightly. This not only creates discomfort for the wearer, but also results in an increase in fatigue and may well reduce the effectiveness of the athletic performance of the wearer.

On the other hand, if a wearer attempts to compensate for the anticipated flexing of the shoe during an athletic contest by tying the shoelace with insufficient initial tension, the shoe will often be too loose on the foot of the wearer. In this circumstance the wearer's footwork is likely to be less agile and more clumsy than is the case when the wearer's shoes are tied more tightly. This loss of agility can adversely affect the athletic performance of a wearer in vigorous sports which demand a high level of rapid movement and agility, such as in the sports of basketball, soccer, tennis and volleyball, for example.

Some articles of footwear have been devised in which the portion of the upper of a shoe above the top of a wearer's foot is equipped with an elastic material. Thus, as the foot is flexed and unflexed the elastic material yields, thus regulating the tension of the footwear across the top of the wearer's foot to some degree.

However, the wearer has no control whatsoever over the amount of elasticity in the shoe upper. Rather, the degree of elasticity in the shoe is determined when the shoe is made and cannot be altered as desired by a user to specific circumstances or according to different sporting activities in which the user may wish to engage.

SUMMARY OF THE INVENTION

The present invention provides the wearer of footwear, particularly footwear that is used while performing athletic events, to selectively regulate and control the tightness with which a shoe is held in position on the wearer's foot. The system of the invention allows the wearer to increase the tension of the shoelaces that hold the shoe on the wearer's foot by adjustments which can be performed in only an instant. The wearer is able to increase or decrease tension far more rapidly than is possible by untying and retying the shoelaces of a pair of shoes.

The shoelace tensioning device of the invention allows a wearer to selectively control the tightness of the shoe at the sole discretion of the wearer, and without any constraint arising out of the construction of the shoe. Should a wearer desire to increase tension in the shoelace so as to hold the shoe tightly on the foot to enhance agility of foot movements, this can be done with the fingers of one hand and without either untying or retying a shoelace. Conversely, should a wearer wish to reduce the tension in the shoelace so as to enhance the level of comfort of the shoe, such an adjustment can likewise be performed with the fingers of a single hand and without untying or retying a shoelace.

The present invention involves a device which is mounted atop the shoe of a wearer, directly above at least some of the eyelets of the shoe. Contrary to accepted practice, the free ends of the shoelace are not tied together, but rather are directed into the tension regulating device. The user then sets the desired level of tension on the shoelace by adjustment of the tensioning device using easy, rapid movements. Furthermore, the device of the invention can be adjusted and readjusted any number of times by the user, swiftly and easily, to optimize tension in the shoelace according to the current level of activity of the wearer.

In one broad aspect the present invention may be considered to be an apparatus for regulating tension on a shoelace having untied free ends and which is laced through the eyelets of a shoe. The apparatus is comprised of a housing having means for securement to the shoe and an opening to receive the free ends of the shoelace. A take-up reel is mounted for rotation within the housing. The take-up reel has means for attachment to the shoelace ends. A crank means is operable from the exterior of the housing to wind the free ends of the shoelace onto the reel thereby increasing tension in the shoelace. A tensioning spring is interposed between the crank means and the reel so as to undergo increased resilient deformation as the free ends of the shoelace are wound further onto the reel. A releasable latching means is also provided for permitting rotation of the reel to increase resilient deformation of the tensioning spring and for impeding counter-rotation of the reel.

By employing the tension regulating apparatus on a shoe, the shoelaces are continually maintained in tension by the tensioning spring within the device. Excessive discomfort to the foot is avoided since extreme flexing movements of the foot that exert substantial force on the free ends of the shoelace are relieved because the tensioning spring within the housing will resiliently yield to allow portions of the free ends of the shoelace to be drawn off the reel and out of the housing slightly and momentarily to temporarily relieve the excessive force. Conversely, when the shoe is unflexed and relaxed the desired level of tension is maintained on the shoelace, since the tensioning spring will then tend to draw the free ends of the shoelace further into the housing.

Adjustment of the tension on the shoelace may be performed by means of a crank means and a crank release means. The housing is preferably of a generally disk-shaped configuration, and the crank means is preferably comprised of a rotatable cap on the housing. The cap has a circular plate mounted atop the housing with an overturned lip at its periphery and a central axial hub extending into the housing. The tensioning spring is preferably a helical band spring having opposite ends. The band spring is confined within the housing between the reel or drum and the crank hub. One of the two opposite ends of the band spring is secured to the crank hub and the other is secured to the reel. Thus, the circular plate of the cap may be manually gripped by the fingers of one hand at the peripheral lip thereof and rotated relative to the housing. Rotation in one direction will tend to further tighten the band spring to increase the tensile force exerted by the band spring on the shoelace ends.

The release mechanism is preferably comprised of a ratchet wheel which is secured to the crank hub and which rotates therewith. A pawl projects from one end of a lever arm that is rotatably mounted to the housing. The pawl is spring biased toward engagement with the teeth of the ratchet wheel. The opposite end of the lever arm protrudes from the housing. As a result, when the crank is turned to tighten the band spring, the shoelace ends are drawn further into the housing and are wound onto the drum. At the same time, the ratchet wheel turns with the drum and the pawl engages the ratchet wheel teeth to prevent counter rotation of the ratchet wheel. Such counter-rotation would otherwise occur due to the energy stored in the band spring.

The means for attaching the shoelace ends to the drum is preferably a hook mechanism which may be bent generally into a "W-shaped" configuration so that each plastic tip of the two free shoelace ends is captured by the hook mechanism. To facilitate engagement of the shoelace tips the take-up reel is preferably provided with a leaf spring which has a first end secured to the take-up reel and a second end that is biased by the leaf spring structure radially outwardly from the take-up reel. The leaf spring is disposed so as to be rotatable into registration with the opening in the housing.

The hook mechanism is mounted on the exposed free end of the leaf spring to facilitate capture of the free ends of the shoelace. Until such time as the shoelace ends are engaged on the hook mechanism, rotation of the drum in the direction permitted by the pawl will periodically result in exposure of the free end of the leaf spring and the hook mechanism mounted thereon at the opening in the housing. The leaf spring is preferably long enough so that, in fact, the free end of the leaf spring with the hook mechanism thereon will protrude outwardly from the housing when that end is brought into registration with the opening in the housing. Once the tips of the shoelace ends are engaged on the hook mechanism, however, the leaf spring and the ends of the shoelace will be carried onto the take-up reel and wound thereon as rotation of the crank continues.

The housing is preferably secured to the shoe by means of a flange depending from the housing and having at least one opening therethrough. The shoelace passes through this opening as it is laced between adjacent eyelets. That is, when the shoe is initially laced up, the flange resides atop the shoe typically three or four eyelets from the ankle. The shoelace ends are passed through the openings in the flange from the eyelets in the shoe therebeneath and are laced crosswise in the conventional manner through the remaining eyelets. The housing is thereby captured atop the shoe, since it is laced onto the shoe by means of the shoelace. The housing and flange are positioned atop the shoe so that the opening in the housing is immediately adjacent the uppermost eyelets at the ankle of the shoe.

The invention may be described with greater clarity and particularity with reference to the accompanying drawings.

DESCRIPTION OF THE EMBODIMENT

Figure 1:
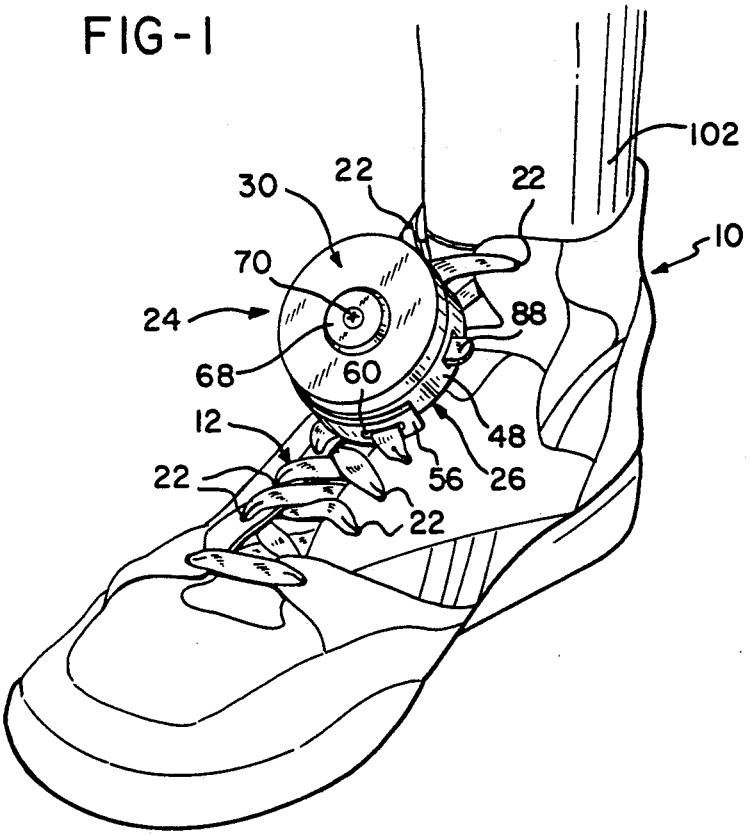
FIG. 1 is a perspective view of an athletic shoe with the shoelace tensioning device of the invention secured thereon.

FIG. 1 illustrates a conventional athletic shoe 10 of the generic type known as a sneaker. The shoe 10 has a canvas or leather upper and a continuous sole and heel formed of a piece of soft rubber. The shoe 10 is of the type that is widely used for participation in vigorous athletic sports, such as basketball, tennis, soccer and track. The upper is centrally divided atop the foot of the wearer from the ankle to the vamp of the shoe 10. The shoe 10 has a plurality of eyelets 22 on the opposite sides of the divided upper which are laced together with a shoelace 12. The shoe is secured on the foot of the wearer by the shoelace 12 which has opposite free ends 14 and 16 that are visible in FIG. 7. The extremities of the shoelace ends 14 and 16 are respectively encased in rigid cylindrical plastic tips 18 and 20.

The invention is a shoelace tensioning device 24 which is adapted for wear on the shoe 10. The shoelace tensioning device 24 regulates tension on the shoelace 12, the opposite free ends 14 and 16 of which are laced through the eyelets 22. The ends 14 and 16 of the shoelace 12 are not tied, but are instead connected to the shoelace tensioning device 24 in the manner illustrated in FIG. 4.

The shoelace tensioning device 10 is provided with a generally disk-shaped, hollow, metal or plastic housing or casing 26. The housing 26 is adapted for wear atop at least some of the eyelets 22 of the shoe 10 in the manner depicted in FIGS. 1 and 2. The housing 26 has an arcuate opening 28 therein, shown in FIGS. 4 and 9 to receive the free ends 14 and 16 of the shoelace 12.

The housing 26 is provided with a rotatable crank means in the form of a cap member 30. The cap 30 fits telescopically atop the housing 26. A drum or reel 32 is mounted for rotation within the housing 26. The reel 32 is provided with a means for capturing the free ends 14 and 16 of the shoelace 12 in the form of a hook mechanism 34. The cap 30 serves as a crank and is operable externally of the housing 26 to rotate the drum 32 in a first direction indicated by the directional arrows 36 in FIGS. 4 and 7 so as to wind the free ends 14 and 16 of the shoelace 12 onto the drum 32.

Figure 6:
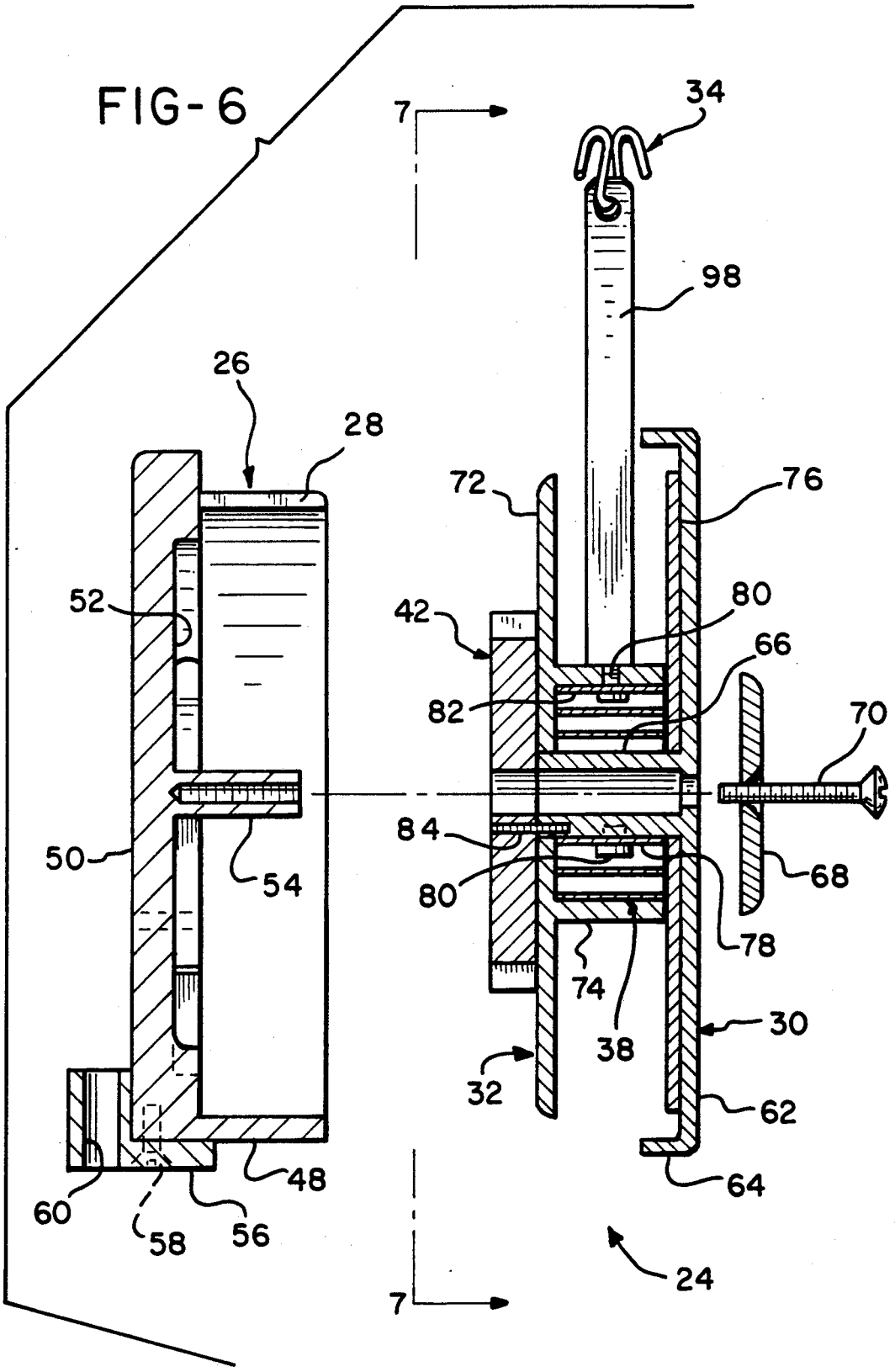
FIG. 6 is an exploded sectional view of the shoelace tensioning device taken along the lines 6—6 of FIG. 3.

A tensioning spring in the form of a helically wound band spring 38, visible in FIG. 6, is interposed between the rotatable cap 30 and the drum 32, whereby rotation of the rotatable cap 30 in the first direction indicated by the directional arrows 36 progressively increases tension on the tensioning band spring 38. The band spring 38 tends to oppose counter-rotation of the drum in the direction indicated by the directional arrow 40 in FIG. 7 which is opposite to the direction 36.

Figure 5:
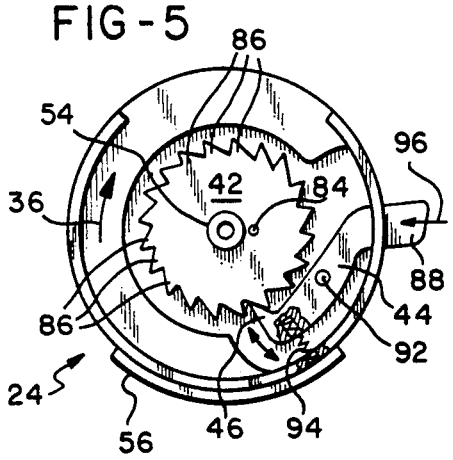
FIG. 5 is a top plan view of the shoelace tensioning device of FIGS. 3 and 4 viewed from above and with the cap removed.

The shoelace tensioning device 24 also includes a releasable means including a ratchet wheel 42, a lever arm 44, and a pawl 46 coupled to the housing 26, as best illustrated in FIG. 5, to permit the rotatable cap 30 to rotate the drum 32 in the direction 36 and to prohibit counter-rotation of the drum 32 in the opposite direction 40.

Figure 2:
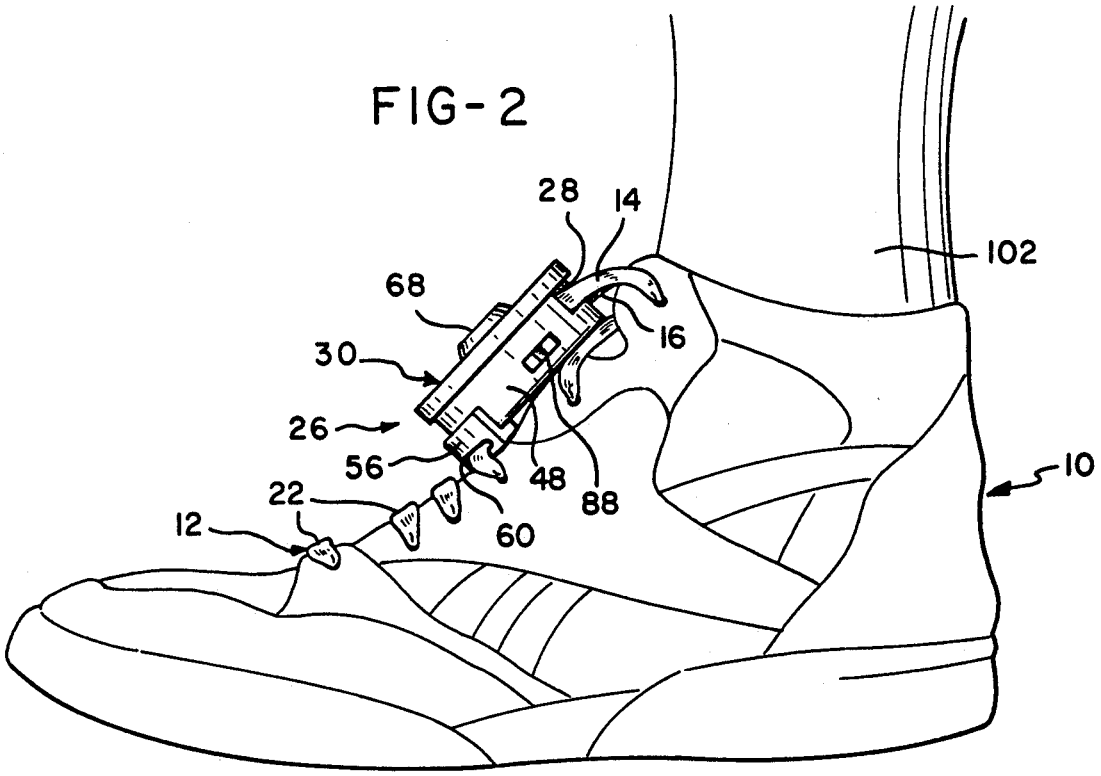
FIG. 2 is a side elevational view showing the shoe and the shoelace tensioning device of FIG. 1.
Figure 4:
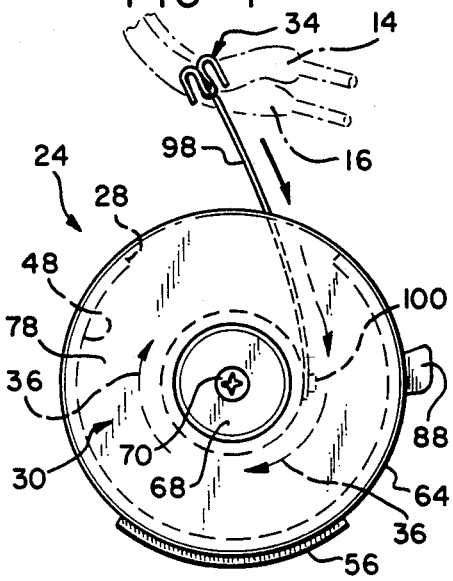
FIG. 4 is a top plan view of the shoelace tensioning device of FIG. 3 showing the manner of engagement of the shoelace ends.
Figure 8:
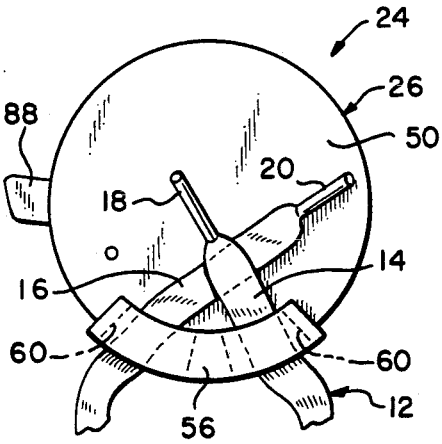
FIG. 8 is a bottom plan view taken along the lines 8—8 of FIG. 3.
Figure 3:
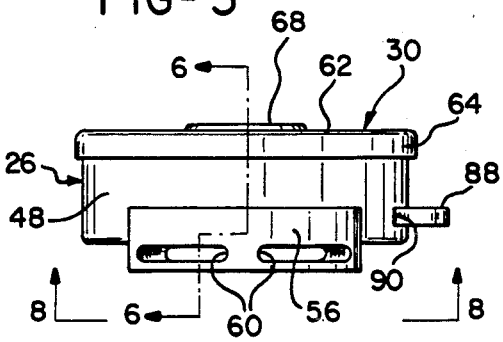
FIG. 3 is a front elevational view of the shoelace tensioning device of FIG. 1.

As illustrated in FIG. 6 the housing 26 is a generally disk-shaped or cup shaped member having an arcuate skirt or sidewall 48 that extends outwardly from a circular, transverse base 50 over an arcuate distance of approximately 280 degrees, as best illustrated in FIG. 4. A gap of about 80 degrees in the sidewall skirt 48 defines the arcuate opening 28 in the housing 26. As shown in FIG. 6, the interior floor 52 of the housing base 50 is slightly recessed so as to receive the ratchet wheel 42. A hollow, internally tapped cylindrical centerpost 54 extends coaxially outwardly from the floor 52 within the surrounding confines of the sidewall skirt 48. Diametrically opposite the opening 28 in the housing 26 there is an arcuate, depending flange 56 which is secured by screws 58 to the base 50. Beneath the base 50 the flange 56 defines a pair of laterally spaced openings 60 therethrough. The shoelace 12 passes through the openings 60 between adjacent eyelets 22, as illustrated in FIGS. 1, 2 and 8.

The rotatable cap 30 has a flat, circular plate 62 that extends across the open side of the housing 26. The plate 62 has an overturned lip 64 at its periphery. The cap 30 is also formed with a central, hollow cylindrical annular axial hub 66 that projects from the plate 62 toward the base 50 of the housing 26. The hub 66 extends into the housing 26 to receive the centerpost 54 therewithin. An annular washer 68 with a central axial depression therein resides atop the outer face of the plate 62. A machine screw 70 is employed to fasten the cap 30 to the housing 26. The externally threaded shank of the screw 70 is engaged in the internal threads of the centerpost 54 of the housing 26. The cap 30 is immobilized axially relative to the housing 26, but is free to rotate relative thereto.

The band spring 38 is formed of spring steel and is helically overwound outwardly from the axial hub 66 of the rotatable cap 30 toward the drum 32. The drum or reel 32 is formed of two members which fit together to form a spool shaped structure. The member 72 of the drum 32 is formed with a flat circular base having a central axial opening therewithin to receive the hub 66 of the rotatable cap 30. Radially outwardly from the central axial opening in the member 72 there is a longitudinally projecting cylindrical annular partition 74 having a radially outer surface upon which the shoelace 12 is wound. The other member 76 of the drum 32 is a flat, circular plate with a central axial opening therein which likewise receives the hub 66 of the rotatable cap 30 therewithin. When the members 72 and 76 of the drum 32 are assembled together on the hub 66, as illustrated in FIG. 6, they form a winding spool, wherein the circular end plates of the members 72 and 76 laterally confine the shoelace 12 to the annular area therebetween.

The tensioning band spring 38 is formed of an elongated ribbon of spring steel which is helically overwound about itself in loops. The band spring 38 has an interior end 78 which is secured by a radially directed screw 80 onto the hub 66 of the rotatable cap 30. The opposite end 82 of the band spring 38 is secured by another screw 80 which is directed radially outwardly into the cylindrical annular partition 74 of the drum member 72. The rotatable cap 30 is thereby connected to the drum 32 by means of the resilient band spring 38 interposed therebetween.

Figure 7:
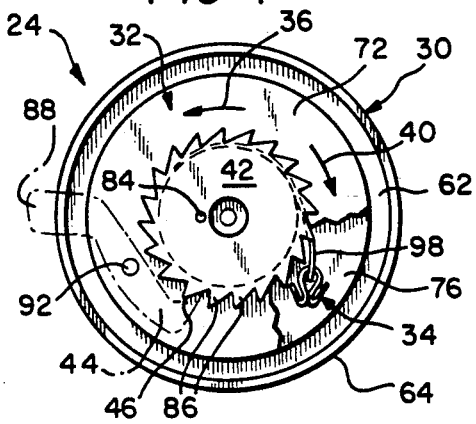
FIG. 7 is a sectional elevational view taken along the lines 7—7 of FIG. 6.

Rotation of the cap 30 in the direction 36 indicated in FIGS. 5 and 7 will tend to cause the drum 32 to rotate in the same direction, although the drum 32 is not rigidly locked to the cap 30. To the contrary, the resiliency of the band spring 38 allows some latitude of movement of the drum 32 relative to the cap 30.

As best shown in FIGS. 5, 6 and 7, the ratchet wheel 42 is secured to the hub 66 of the rotatable cap 30 by means of a coupling pin 84 which extends longitudinally through the ratchet wheel 42 and into the structure of the hub 66. Since the ratchet wheel 42 has a central, axial opening therethrough and is thereby held in coaxial alignment with the centerpost 54, which in turn is coaxially aligned with the hub 66, the ratchet wheel 42 is coupled in locked engagement with the cap 30. The ratchet wheel 42 will thereby move through one complete revolution with each revolution of the cap 30.

As illustrated in FIGS. 5 and 7, the teeth 86 of the ratchet wheel 42 are angled back in a direction opposite to the direction 36. The pawl 46 is mounted at the interior end of the lever arm 44 and projects radially toward the ratchet wheel 42. The opposite end 88 of the lever arm 44 is angled at a dog leg outwardly from the housing 26 through a slot 90 therein. The lever arm 44 is rotatably mounted to the base 50 of the housing 26 by means of a pivot pin 92, which serves as a fulcrum. The end of the lever arm 44 bearing the pawl 46 is biased radially inwardly toward the ratchet wheel 42 by means of a small coil spring 94 which is compressed between the flange 56 and a recess in the back side in the end of the lever arm 44 bearing the pawl 46, as illustrated in FIG. 5. The spring 94 therefore biases the pawl 46 toward engagement with the teeth 86 of the ratchet wheel 42. The pawl 46 can be released from engagement with the ratchet wheel 42 by depression of the protruding end 88 of the lever arm 44 toward the housing 26 as indicated by the directional arrow 96 in FIG. 5. The protruding end 88 of the lever 44 thereby serves as a means operable externally of the housing 26 to disengage the pawl 46 from the ratchet wheel 42.

Figure 9:
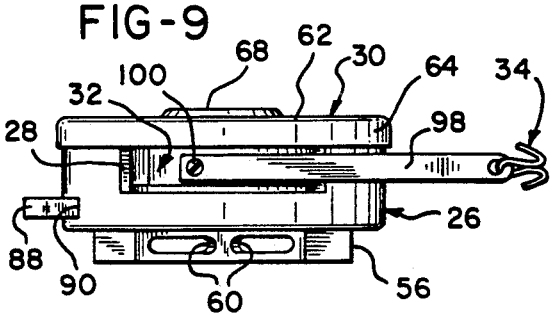
FIG. 9 is a rear elevational view of the shoelace tensioning device of FIG. 3.

FIGS. 4 and 9 best illustrate the manner in which the shoelace ends 14 and 16 are engaged by the hook mechanism 34. As illustrated, the hook mechanism 34 is a rigid steel wire formed generally in the shape of a "W" and secured through an opening in one end of a leaf spring 98. The opposite end of the leaf spring 98 is secured to the cylindrical annular partition 74 of the drum 32 by means of a screw 100. The leaf spring 98 is preferably of a length substantially greater than the diameter of the housing 26, as illustrated. The free end of the leaf spring 98 is thereby biased radially outwardly from the drum 32 toward registration with the opening 28 in the housing 26. The leaf spring 98 will tend to maintain a linear alignment, although rotation of the cover 30 in the direction of the directional arrows 36 will cause it to arcuately bend and conform to the interior surface of the housing sidewall skirt 48. Nevertheless, with each rotation of the cap 30 the resiliency of the leaf spring 98 will cause the protruding end of the leaf spring 98 bearing the hook mechanism 34 to spring outwardly through the opening 28 each time the free end of the leaf spring 98 bearing the hook mechanism 34 arrives in registration with the opening 28.

With the leaf spring 98 extending from the opening 28 as depicted in FIG. 4, the ends 14 and 16 of the shoelace 12 can be easily captured by the hooks on the hook mechanism 34. The wire forming the mechanism 34 is stiff enough and is bent tightly enough so that the plastic tips 18 and 20 cannot be drawn through the crooks of the hook mechanism 34 as the shoelace 12 is wound onto the drum 32 by rotation of the cap 30 in the direction 36.

The use of the shoelace tension regulating device 24 may now be described. Prior to completely lacing up the shoelace 12 the user positions the device 24 atop the shoe with the opening 28 directed toward the wearer's ankle 102 and with the flange 56 facing the vamp of the shoe. As the ends 14 and 16 of the shoelace 12 emanate from the fourth pair of eyelets 22 immediately adjacent the flange 56, they are passed through the openings 60 in the flange 56 in the manner illustrated in FIG. 8. Lacing of the shoelace ends 14 and 16 is then continued in a conventional manner with the lace ends 14 and 16 crossing back and forth over the top of the shoe tongue up to the uppermost eyelets 22 at the top of the shoe 10.

When the shoelace ends 14 and 16 emanate from the uppermost eyelets 22 immediately adjacent the wearer's ankle 102, they are not tied at all. Rather, each of the ends 14 and 16 is captured in a separate one of the hooks of the hook mechanism 34 in the manner depicted in FIG. 4. Once the shoelace ends 14 and 16 have been attached to the tension regulating device 24 by means of the hook mechanism 34, the cap 30 is rotated in the direction 36 indicated in FIGS. 4, 5 and 7. Rotation of the cap 30 causes both the drum 32 and the ratchet wheel 42 to rotate in the same direction as the cap 30. The shoelace ends 14 and 16 are thereby carried into the enclosure between the housing 26 and the cap 30 and are helically wound on the cylindrical wrapping surface of the partition 74 of the drum 32 between the circular plates 72 and 76.

Although the helical band spring 38 is placed under increased tension as rotation of the cap 30 continues in the direction 36, the pawl 46 is biased into engagement with the ratchet wheel 42 and latches between the passing teeth 86 so as to prevent counter-rotation of the ratchet wheel 42 in the direction 40, which is opposite the winding direction 36. Therefore, even though the band spring 38 is placed under increased tension and exerts a counter-rotating force on the drum 32, the engaged ratchet wheel 42 which is locked to the drum 32 does not permit the drum 32 to turn in counter-rotation.

The user continues to wind the shoelace ends 14 and 16 onto the drum 32 by continued rotation of the cap 30 in the direction 36 until the user is satisfied with the tension exerted on the ends 14 and 16 of the shoelace 12 by the wound band spring 38. The user then participates in any athletic endeavor desired.

As the user moves and the upper of the shoe 10 flexes with this movement, the ends 14 and 16 of the shoelace 12 can move somewhat into and out of the opening 28 due to the resiliency of the coiled band spring 38. When the shoe upper is flexed severely the resiliency of band spring 38 allows a short length of the shoelace ends 14 and 16 to be drawn out of the housing 26, due to the further resilient deformation of the band spring 38 that results from the flexing force. Conversely, when the flexing force is removed the tension of the band spring 38 tugs on the ends 14 and 16 of the shoelace 12 and draws further short lengths thereof back into the housing 26.

Should the wearer at any time experience discomfort or annoyance, due either to overtightening or undertightening of the shoelace 12, the tension on the shoelace 12 can be adjusted quickly and easily. To increase tension on the shoelace 12 once the ends 14 and 16 of the shoelace 12 have been wound onto the drum 32, the user merely rotates the cap 30 relative to the housing 26 in the direction 36. As the ratchet wheel 42 turns in that direction, the band spring 38 is placed under increased tension. When the wearer is satisfied with the tension exerted on the shoelace ends 14 and 16, the cap 30 can be released. The pawl 46 interacts with the ratchet wheel 42 to prevent counter-rotation of the drum 32, except to the extent permitted by the resiliency of the wound band spring 38. The tighter the band spring 38 is wound, the greater will be the tension exerted on the ends 14 and 16 of the shoelace 12.

To reduce tension on the shoelace 12 one merely presses the protruding end 88 of the pawl lever 44 inwardly toward the ratchet wheel 42 from the outside of the housing 26. This draws the pawl 46 out of engagement with the ratchet wheel 42 so that the tension of the wound band spring 38 can be relieved somewhat by counter-rotation of the drum 32 under the force exerted by the band spring 38.

This same technique is used when one wishes to remove the shoe 10 from the wearer's foot. That is, to remove the shoe 10 the lever 88 is pressed radially inwardly toward the housing 26 and the shoelace ends 14 and 16 are pulled completely free from the housing 26. Once the shoelace ends 14 and 16 have been unwound to expose the leaf spring 98, the leaf spring 98 will project outwardly through the opening 28 thereby allowing the shoelace tips 18 and 20 to be disengaged from the hooks of the hook mechanism 34. The shoe 10 is then removed from the wearer's foot in the usual manner.

By utilizing a pair of the shoelace tension regulating devices 24 as described, an athlete can accurately control the comfort of athletic footwear while engaging in vigorous activity. The resiliency of the band spring 38 allows slight, reciprocal movement of the shoelace ends 14 and 16 relative to the eyelets 22 in response to flexing movement of the footwear. This tends to maintain an even tension on the shoelace 12, thereby enhancing the comfort experienced by the wearer. Once the tension on the band spring 38 has been adjusted to the satisfaction of the wearer by use of the crank mechanism provided in the form of the rotatable cap 30, the wearer can exercise in comfort and will not experience the discomfort that arises from the use of conventional shoes in which the laces are tied.

Undoubtedly, numerous variations and modifications of the invention will become readily apparent to those familiar with footwear. For example, the application of the shoelace tension regulating device is not limited to athletic footwear, but may be employed with any type of laced footwear. In this connection the invention significantly enhances the comfort of individuals engaged in types of vigorous activity other than athletic competition. The invention greatly increases the comfort of footwear worn by individuals who march extensive distances as well as individuals who bend, stoop and walk substantial distances in their occupations. Accordingly, the scope of the invention should not be construed as limited to this specific embodiment depicted and described herein, but rather is defined in the claims appended hereto.

I claim:

1. In combination, a shoe having an upper with a central division therein and a plurality of eyelets in said upper disposed on opposite sides of said central division, a shoelace laced through said eyelets so as to repeatedly cross over said central division and having opposite untied free ends that emanate from said upper on opposite sides of said central division, an apparatus for regulating tension on said untied free shoelace free ends comprising:

(a) a housing disposed atop said upper and having means secured to said shoe and an opening to receive said free ends of said shoelace, (b) a take-up reel mounted for rotation within said housing and having shoelace capturing means releasably attached to both of said shoelace ends, (c) crank means operable from the exterior of said housing to wind said ends of said shoelace onto said reel thereby increasing tension on said shoelace, (d) a tensioning spring interposed between said crank means and said reel so as to undergo increased resilient deformation as said free ends of said shoelace are wound onto said reel, and (e) releasable means for permitting rotation of said reel relative to said housing to increase resilient deformation of said tensioning spring and for impeding counter-rotation of said reel.

2. A combination according to claim 1 wherein said releasable means is comprised of a ratchet wheel secured to said reel and a pawl rotatably mounted to said housing and spring biased toward said ratchet wheel.

3. A combination according to claim 2 further comprising a lever arm having one end which carries said pawl and an opposite end that protrudes from said housing.

4. A combination according to claim 1 wherein said crank means is comprised of a circular plate on said housing having an overturned lip at its periphery and a central hub extending into said housing, and said tensioning spring has opposite ends, one of which is secured to said crank hub and the other of which is secured to said reel.

5. A combination according to claim 4 wherein said tensioning spring is a helical band spring confined within said housing between said reel and said crank hub.

6. A combination according to claim 1 wherein said means for attachment of said take-up reel includes a leaf spring having a first end secured to said take-up reel and a second end biased radially outwardly from said take-up reel and in rotatable registration with said opening in said housing.

7. A combination according to claim 6 wherein said means for attachment further includes a hook mechanism mounted on said second end of said leaf spring for capturing said free ends of said shoelace.

8. A combination according to claim 1 wherein said means for securement on said housing is comprised of a flange depending from said housing and having at least one opening therethrough through which said shoelace passes between adjacent eyelets.

9. In combination, a shoe having a centrally divided upper with a plurality of eyelets in opposite sides thereof, a shoelace laced through said eyelets so as to repeatedly pass between said opposite sides of said upper and having a pair of opposite, untied free ends which emanate from said opposite sides of said upper, a shoelace tensioning device housing having means secured to said shoe atop at least some of said eyelets and having an opening therein to receive said free shoelace ends, a shoelace tensioning drum disposed for rotation within said housing and having attachment means which releasably captures said free shoelace ends, whereby rotation of said drum in a first direction of rotation winds said shoelace ends onto said drum, rotatable means operable externally of said tensioning device housing to rotate said drum in said first direction, a shoelace tensioning spring coupled to said drum and to said rotatable means so as to undergo increased resilient deformation upon rotation of said drum in said first direction of rotation, and releasable means coupled to said shoelace tensioning device housing to permit said rotatable means to rotate said drum in said first direction and to prohibit counter-rotation of said drum in a direction opposite to said first direction.

10. A combination according to claim 9 wherein said releasable means is comprised of a ratchet wheel coupled to move with said rotatable means, a pawl rotatably mounted to said housing by means of a lever arm that protrudes from said housing, and a pawl biasing spring interposed between said housing and said pawl to urge said pawl toward said ratchet wheel.

11. A combination according to claim 10 wherein said shoelace tensioning spring is a helically wound band spring encapsulated within said housing and having opposite ends, one of which is secured to said drum and the other of which is secured to said rotatable means.

12. A combination according to claim 11 wherein said rotatable means is a crank wheel mounted for rotation on said housing and having a hub to which said other end of said band spring is secured.

13. A combination according to claim 9 further comprising a leaf spring having one end secured to said drum and an opposite end biased radially outwardly therefrom toward registration with said opening in said housing that receives said shoelace ends, and said attachment means for releasably capturing said shoelace ends is comprised of a hook mechanism on said opposite end of said leaf spring.

14. A combination according to claim 13 wherein said leaf spring is long enough to project through said opening in said housing when in registration therewith.

15. A combination according to claim 9 wherein said housing is equipped with aperture means to serve as said means for securement, whereby said shoelace passes through said aperture means between mutually adjacent eyelets of said shoe.

16. In combination, a shoe having an upper with a central division therein and a plurality of eyelets therein on the opposite sides of said central division, a shoelace laced through said eyelets so as to repeatedly cross over said central division and having a pair of opposite, untied free ends which emanate from said upper on opposite sides of said central division, a tension regulating device casing mounted on said shoe atop at least some of its said eyelets of said shoe and having an opening therein to receive said free ends of said shoelace, a tensioning device drum mounted for rotation within said casing and having means capturing said free ends of said shoelace, rotatable means operable externally of said casing to rotate said drum in a first direction so as to wind said free ends of said shoelace onto said drum, a tensioning spring interposed between said rotatable means and said drum, whereby rotation of said rotatable means in said first direction progressively increases tension on said tensioning spring, and releasable means interposed between said casing and said drum to permit said rotatable means to rotate said drum in said first direction while inhibiting counter-rotation of said drum in said direction opposite to said first direction.

17. A combination according to claim 16 wherein said releasable means is comprised of a ratchet, a pawl biased toward engagement with said ratchet, and means operable externally of said casing to disengage said pawl from said ratchet.

18. A combination according to claim 16 wherein said rotatable means is comprised of a crank wheel mounted on said housing and having a hub that extends into said housing and said tensioning spring is a band spring disposed helically about said hub and having a first end secured thereto and an opposite end secured to said drum.

19. A combination according to claim 16 wherein said means for capturing said free ends of said shoelace is comprised of a hook carried on a free end of a leaf spring, the opposite end of which is secured to said drum, whereby said leaf spring is biased outwardly from said drum and is rotatable into registration with said opening in said casing.

* * * * *